US012678701B2

(12) United States Patent
Chen

(10) Patent No.: US 12,678,701 B2
(45) Date of Patent: Jul. 14, 2026

(54) OMNIDIRECTIONAL REMOTE CONTROL TOY CAR

(71) Applicant: Bo Chen, Shantou City (CN)

(72) Inventor: Bo Chen, Shantou City (CN)

(73) Assignee: Shantou P&C Plastic Products Company Limited, Shantou City (CN)

( * ) Notice: Subject to any disclaimer, the term of this patent is extended or adjusted under 35 U.S.C. 154(b) by 300 days.

(21) Appl. No.: 18/665,585

(22) Filed: May 16, 2024

(65) Prior Publication Data

US 2025/0213994 A1 Jul. 3, 2025

(30) Foreign Application Priority Data

Dec. 29, 2023 (CN) ..... 202311849898.5
Dec. 29, 2023 (CN) ..... 202323634635.0

(51) Int. Cl.
*A63H 17/36* (2006.01)

(52) U.S. Cl.
CPC ..... *A63H 17/36* (2013.01)

(58) Field of Classification Search
CPC ..... A63H 17/36; A63H 17/395
See application file for complete search history.

(56) References Cited

U.S. PATENT DOCUMENTS 3,909,276 A * 9/1975 Wolf ..... A63H 17/12 446/454
4,881,917 A * 11/1989 Suzuki ..... A63H 17/36 446/484
4,892,503 A * 1/1990 Kumazawa ..... A63H 17/004 446/460
5,762,554 A * 6/1998 Siu ..... A63H 17/395 463/37
6,827,627 B2 * 12/2004 Tsang ..... A63H 17/36 446/457
7,938,709 B2 * 5/2011 Leonov ..... A63H 17/36 446/454
8,302,728 B1 * 11/2012 Dotson ..... A63H 17/262 180/408
8,932,102 B2 * 1/2015 Wong ..... A63H 17/395 446/460
9,120,511 B1 * 9/2015 Beard ..... B60L 15/20
12,172,094 B2 * 12/2024 Miyama ..... A63H 17/36
2014/0227941 A1 * 8/2014 Suzuki ..... A63H 17/36 446/456
2018/0071646 A1 * 3/2018 Erhart ..... A63H 17/395
(Continued)

*Primary Examiner* — Kurt Fernstrom
(74) *Attorney, Agent, or Firm* — Minder Law Group; Willy H. Wong

(57) ABSTRACT

One embodiment of the present invention discloses a remote-controlled toy vehicle with omnidirectional adjustable steering, comprising: a vehicle body having a remote control receiving circuit; a remote control device capable of communicating with the remote control receiving circuit; at least one steering means mounted on the vehicle body; and a plurality of wheels; wherein each steering means comprises a steering drive means, a pivot rod, a connecting rod, at least one swivelable member, and at least one wheel bracket, with the number of swivelable members. The present remote-controlled toy vehicle with omnidirectional adjustable steering can steer at various angles, enabling flexible control over its driving direction, while having a simple structure and offering convenient control and adjustment operations.

10 Claims, 11 Drawing Sheets

(56) References Cited

U.S. PATENT DOCUMENTS

| | | | | |
|---|---|---|---|---|
| 2020/0338464 | A1* | 10/2020 | Pipitone | G05D 1/0246 |
| 2022/0347592 | A1* | 11/2022 | Qin | A63H 17/262 |
| 2025/0213994 | A1* | 7/2025 | Chen | A63H 30/04 |

* cited by examiner

OMNIDIRECTIONAL REMOTE CONTROL TOY CAR

RELATED APPLICATIONS

This application claims priority to Chinese Patent Application No. 202311849898.5, filed Dec. 29, 2023; and to Chinese Patent Application No. 202323634635.0, filed Dec. 29, 2023.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention relates to the field of remote-controlled vehicles, particularly to a remote-controlled toy vehicle with omnidirectional adjustable steering.

BACKGROUND

Remote-controlled toy vehicles have gained immense popularity among boys of all ages, attributed to their captivating entertainment value and appealing designs.

However, existing remote-controlled vehicles have limited steering angles, typically only allowing wheels to turn 18-25°, resulting in cumbersome steering and large turning radii.

Recently, remote-controlled vehicles featuring increased wheel turning angles have emerged.

For example, Chinese patent literature [Application No.: CN204121749U, Publication Date: Jan. 28, 2015] discloses a remote-controlled toy vehicle with enhanced steering maneuverability, comprising: a vehicle body, front and rear wheels, and a steering mechanism; wherein, the steering mechanism comprises: a gear case; a lateral linkage assembly connecting two front wheels and capable of steering the two front wheels; a steering motor; a transmission gear set; a steering actuator; and a rotary potentiometer; and wherein, the steering actuator consists of: an L-shaped lever integrally positioned on one side of an output gear within the transmission gear set, and a peg integrally formed with the L-shaped lever and perpendicular to a movement plane of the L-shaped lever; and wherein, the peg is up-and-down slidably connected to the lateral linkage assembly. This structure enables the remote-controlled vehicle to achieve a maximum wheel steering angle of approximately 45°.

Despite the increased steering angle, such remote-controlled vehicle still lacks omnidirectional steering adjustment, and its steering structure, as described above, is complex, occupying a significant amount of space within the vehicle body.

Currently, some remote-controlled vehicles utilizes multiple motors to independently drive each wheel, enabling steering by controlling a differential speed of each wheel. However, this method requires simultaneous control of the multiple wheel motors, making it challenging to fine-tune steering angles and only convenient for extreme steering angle adjustments (such as rotating the vehicle in place or driving sideways).

SUMMARY

An objective of one embodiment of the present invention is to provide a remote-controlled toy vehicle with omnidirectional adjustable steering, which can steer at various angles, enabling flexible control over its driving direction, while having a simple structure and offering convenient control and adjustment operations.

The objective of the present invention can be achieved by the following technical solution.

A remote-controlled toy vehicle with omnidirectional adjustable steering, comprising:

- a vehicle body having a remote control receiving circuit;
- a remote control device capable of communicating with the remote control receiving circuit;
- at least one steering means mounted on the vehicle body; and
- a plurality of wheels;
- wherein each steering means comprises a steering drive means, a pivot rod, a connecting rod, at least one swivelable member, and at least one wheel bracket, with the number of swivelable members and the number of wheel brackets in the steering means being the same as the number of the wheels connected to the steering means;
- wherein in each steering means, the pivot rod is connected at a first end to a power output end of the steering drive means and hinged at a second end to a middle of the connecting rod;
- wherein each swivelable member is swivelably mounted on the vehicle body and hinged to the connecting rod at a hinge position offset from a swivel center of the swivelable member;
- wherein each wheel bracket is fixedly connected at an upper end to the swivelable member and hinged at a lower end to a corresponding wheel; and
- wherein at least one wheel at a front of the vehicle is independently driven from at least one wheel at a rear of the vehicle.

In the above remote-controlled toy vehicle with omnidirectional adjustable steering, a front steering means and a rear steering means control steering of a front wheel and a rear wheel, respectively, while the swivelable member positions its swivel center at a connection point with the wheel bracket.

During a steering control, the steering drive means maneuver the connecting rod laterally. This lateral movement of the connecting rod also causes the connecting rod to move forward and backward, thereby changing an angular position of the hinge between the swivelable member and the connecting rod, with respect to the swivel center of the swivelable member. As a result, the movement of the connecting rod induces the swivelable member to swivel, leading to the swivel of the corresponding wheel brackets, thereby enabling simultaneous swivel of the direction of all corresponding wheels.

With such a steering mechanism in the above remote-controlled toy vehicle with omnidirectional adjustable steering, a front steering means and a rear steering means can be implemented to independently drive front wheels and rear wheels respectively, or to independently drive left wheels and right wheels respectively.

Moreover, since the swivelable member is linked to a wheel via the wheel bracket rather than directly, the swivelable member and connecting rod can be positioned above or below a wheel, as well as offset from the wheel, thereby effectively circumvents constraints imposed by the wheel's position on the movement of the swivelable member and connecting rod, theoretically enabling the swivelable member to swivel 360° (It should be noted that, in practical application, swiveling the swivelable member to 180° is sufficient, resulting in a wheel turning angle of 90° to both the left and right).

Under the combined steering of the front steering means and rear steering means, the remote-controlled vehicle can achieve steering at various angles, and the steering angle can be finely adjusted as needed, making adjustment convenient.

Therefore, when using the front steering means and rear steering means to independently control steering of the front wheels and rear wheels respectively, seamless omnidirectional steering of the remote-controlled vehicle can be achieved.

In one preferred embodiment, in the swivelable member, a distance from the swivel center of the swivelable member to the hinge position of the swivelable member, where the swivelable member is hinged to the connecting rod, equals a length of the pivot rod.

In one preferred embodiment, in each steering means, each swivelable member is provided with an eccentric hole, and the connecting rod is provided with a pin shaft capable of being inserted into the eccentric hole to hinge the swivelable member and the connecting rod together.

In one preferred embodiment, in each steering means, each swivelable member is a swivelable cylinder swivelably mounted on the vehicle body, and the eccentric hole is provided at a position offset from the swivel center of the swivelable cylinder.

In one preferred embodiment, in each steering means, each swivelable member is a pivot arm having a pivot end and a fixed end fixedly connected to a corresponding wheel bracket, with the eccentric hole being provided at the pivot end of the pivot arm, and the fixed end of the pivot arm being swivelably connected to the vehicle body.

In one preferred embodiment, there are two wheels, two swivelable members, and two wheel brackets at the front of the vehicle; there are two wheels, two swivelable members, and two wheel brackets at the rear of the vehicle; and in each steering means, each of two ends of the connecting rod is hinged to the eccentric hole of a corresponding swivelable member.

In one preferred embodiment, in each steering means, the steering drive means is a servo drive or servo electric motor, and the pivot rod is connected to an output shaft of the servo drive or servo electric motor. The steering drive means adopts a commonly seen servo drive or servo electric motor, and during steering control, it operates similarly to typical remote-controlled vehicle steering mechanisms, enabling convenient adjustment of the steering angle as required.

In one preferred embodiment, the remote-controlled toy vehicle with omnidirectional adjustable steering further comprises a plurality of wheel drive means, with the number of the plurality of wheel drive means being the same as the number of the plurality of wheels; and each wheel drive means is mounted on a corresponding wheel bracket and has a power output end in transmission connection with one of the plurality of wheels.

A wheel employing this structure can function as an independently driven wheel, and when in use, can be driven to rotate by an in-wheel wheel drive means controlled by a user, thereby propelling the remote-controlled vehicle; moreover, this structure can increase the remote-controlled vehicle's horsepower, as each wheel is powered by an independent wheel drive means; furthermore, this structure enables the remote-controlled vehicle to seamlessly transition between various movement modes by providing individual control over the rotational speed of each wheel.

In one preferred embodiment, each of the plurality of wheels, together with the corresponding wheel bracket, form a first-type wheel-unit structure having a first inner cavity for accommodating a corresponding wheel drive means and allowing a main body of the corresponding wheel drive means to be mounted within the wheel bracket; and each of the plurality of wheel drive means is provided with a first mounting shaft, enabling each of the plurality of wheels to be rotatably sleeved onto the first mounting shaft to establish a transmission connection with the power output end of the corresponding wheel drive means.

With this structure, each of the plurality of wheels, together with the corresponding wheel bracket, can combine to form a commonly seen wheel-unit structure; and each of the plurality of wheels can swivel relative to the corresponding wheel bracket, and during swivel, can be driven by the corresponding wheel drive means to rotate around the first mounting shaft;

the wheel drive means can be concealed in the hollow space within the first inner cavity, eliminating the need to occupy space within the vehicle body of the remote-controlled vehicle, avoiding interference with an internal layout of the vehicle body or the steering mechanism, making it suitable for remote-controlled vehicles of various sizes.

In one preferred embodiment, each of the plurality of wheel drive means comprises:

- a first housing fixedly mounted on the corresponding wheel bracket;
- a first electric motor mounted on the first housing; and
- a first gear set;
- wherein the first mounting shaft is mounted on the first housing;
- wherein both the first electric motor and the first gear set are disposed within the first housing; and
- wherein an initial gear of the first gear set is mounted on an output shaft of the first electric motor, and a final gear of the first gear set is rotatably sleeved onto the first mounting shaft and connected to one of the plurality of wheels.

The first electric motor, via the first gear set, drives each of the plurality of wheels to rotate around the first mounting shaft.

In one preferred embodiment, in each of the plurality of wheel drive means, a first shaft sleeve with a first external spline is positioned on a gear end face of the final gear of the first gear set and rotatably sleeved onto the first mounting shaft; and each of the plurality of wheels is provided with a first internal splined hole for engaging with the first external spline on the corresponding first shaft sleeve.

The final gear of the first gear set, via the first shaft sleeve, can set each of the plurality of wheels into rotation.

In one preferred embodiment, in each steering means, each wheel bracket comprises a first fixing member and a second fixing member; each of the plurality of wheels consists of a first rolling member and a second rolling member; the first fixing member, the first rolling member, the second fixing member, and the second rolling member are arranged in a right-to-left sequence to form the first-type wheel-unit structure; a first connecting member is provided on the first fixing member, and a second connecting member matching the first connecting member is provided on the second fixing member, so that the first fixing member is fixedly connected to the second connecting member on the second fixing member through the first connecting member; each of the plurality of the wheel drive means is fixedly mounted within a corresponding first fixing member; a third connecting member is provided on the first rolling member, and a fourth connecting member matching the third connecting member is provided on the second rolling member, so that the first rolling member is fixedly connected to the fourth connecting member on the second rolling member through the third connecting member; and the first internal splined hole is provided on either the first rolling member or the second rolling member.

This structure enables the first fixing member and the second fixing member to restrict the lateral movement of the first rolling member, thereby preventing lateral oscillation of the first rolling member during rotation.

In one preferred embodiment, one side edge of the first rolling member is provided with a first annular protruding ridge or a first annular groove; and the first fixing member or the second fixing member is provided with a second annular groove or a second annular protruding ridge matching the first annular protruding ridge or the first annular groove.

When the first rolling member comes into contact with the first fixing member or the second fixing member, the interaction between the annular protruding ridge and the annular groove can further restrain lateral oscillation of the first rolling member during rotation.

In one preferred embodiment, the first connecting member is disposed on an outer side of the first fixing member; the second connecting member is disposed on an outer side of the second fixing member; the first connecting member and the second connecting member are together connected to the swivelable member; a first through hole is provided on the second fixing member; the third connecting member is disposed on an inner side of the first rolling member; the fourth connecting member is disposed on an inner side of the second rolling member; the third connecting member passes through the first through hole to fixedly connected to the fourth connecting member; the first internal splined hole is provided on the first rolling member.

The third connecting member and the fourth connecting member may each be configured with a different hole type: one with a through hole and the other with a threaded hole, facilitating their connection by inserting a screw through the through hole and securing the screw into the threaded hole.

In one preferred embodiment, the first fixing member and the second rolling member are respectively spherical-cap-shaped; the second fixing member and the first rolling member are respectively annular-ring-shaped; and the first fixing member, the first rolling member, the second fixing member, and the second rolling member collectively form the first wheel-unit structure in a spherical shape.

In one preferred embodiment, a first tire is provided on an outer surface of the first rolling member, enhancing traction and preventing slippage.

In one preferred embodiment, each of the plurality of wheels forms a second-type wheel-unit structure having a second inner cavity and a second through hole; each of the plurality of wheel drive means is disposed in a corresponding second inner cavity and is provided with a second mounting shaft; in each of the plurality of wheel drive means, one end of the second mounting shaft extends through the second through hole to the outside of a corresponding wheel and is fixedly connected to the corresponding wheel bracket; and each of the plurality of wheels is rotatably sleeved onto the second mounting shaft to connect with a power output end of the corresponding wheel drive means.

With this structure, the wheel drive means can be concealed in the hollow space within the second inner cavity, eliminating the need to occupy space within the vehicle body of the remote-controlled vehicle, avoiding interference with an internal layout of the vehicle body or the steering mechanism, making it suitable for remote-controlled vehicles of various sizes;

each of the plurality of wheels can alone form a commonly seen wheel-unit structure; and each of the plurality of wheels can rotate relative to the corresponding wheel bracket, and during rotation, can be driven by the corresponding wheel drive means to rotate around the second mounting shaft.

In one preferred embodiment, each of the plurality of wheel drive means comprises:

a second housing;

a second electric motor; and a second gear set; and wherein in each of the plurality of wheel drive means, the second mounting shaft is positioned on the second housing, the second electric motor and the second gear set are respectively disposed in the second housing;

wherein an initial gear of the second gear set is in transmission connection with an output shaft of the second electric motor, a final gear of the second gear set is rotatably sleeved onto the second mounting shaft and connected to the corresponding wheel.

The second motor, via the second gear set, drives each of the plurality of wheels to rotate around the second mounting shaft.

In one preferred embodiment, a second shaft sleeve with a second external spline is positioned on the final gear of the second gear set and rotatably sleeved onto the second mounting shaft; in each of the plurality of wheels, the second through hole is a second internal splined hole matching the second external spline; and each of the plurality of wheels is engaged with the second external spline on a corresponding second shaft sleeve through the second internal splined hole.

In one preferred embodiment, a second tire is provided on and sleeved onto each of the plurality of wheels.

Compared to the prior art, the present invention has the following advantages: the present remote-controlled toy vehicle with omnidirectional adjustable steering can steer at various angles, enabling flexible control over its driving direction, while having a simple structure and offering convenient control and adjustment operations.

DETAILED DESCRIPTION

Figure 1:
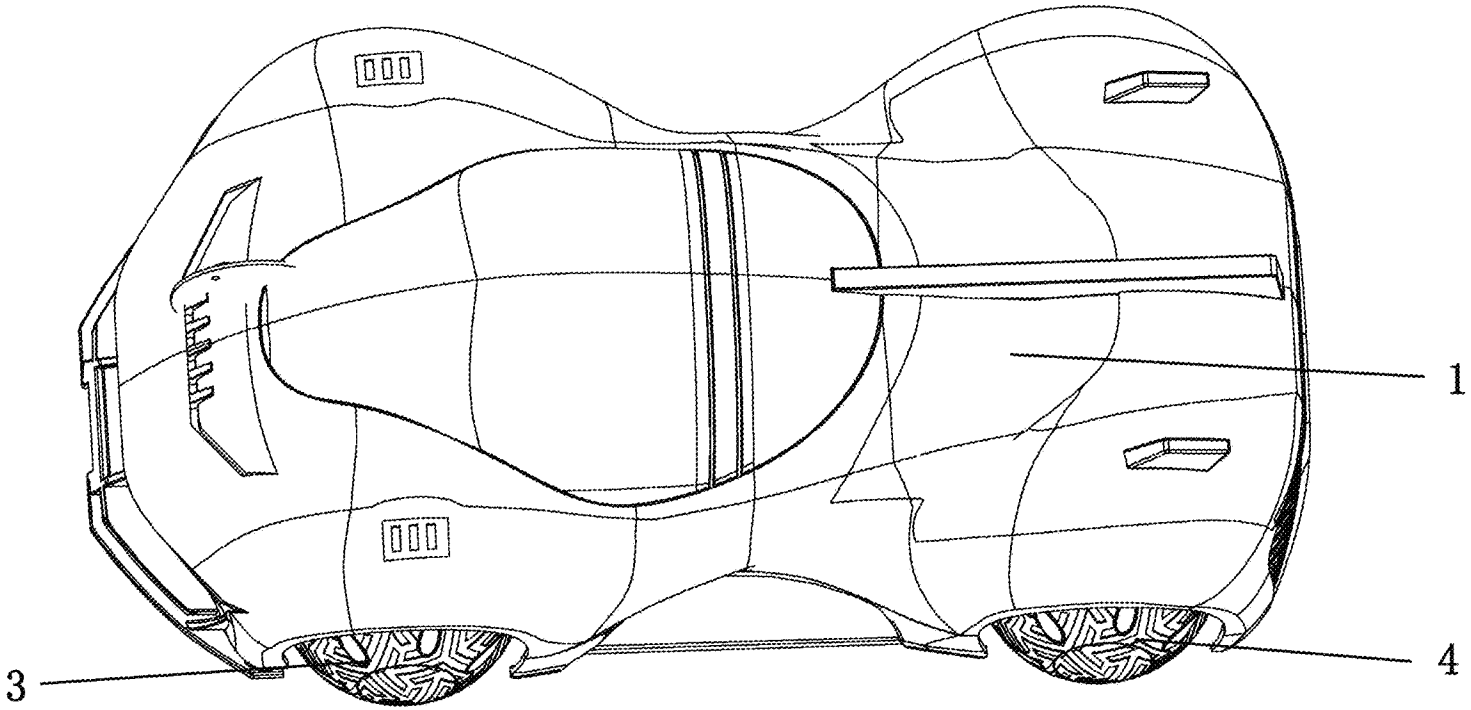
FIG. 1 is a perspective view of a remote-controlled toy vehicle with omnidirectional adjustable steering in Embodiment I of the present invention.
Figure 2:
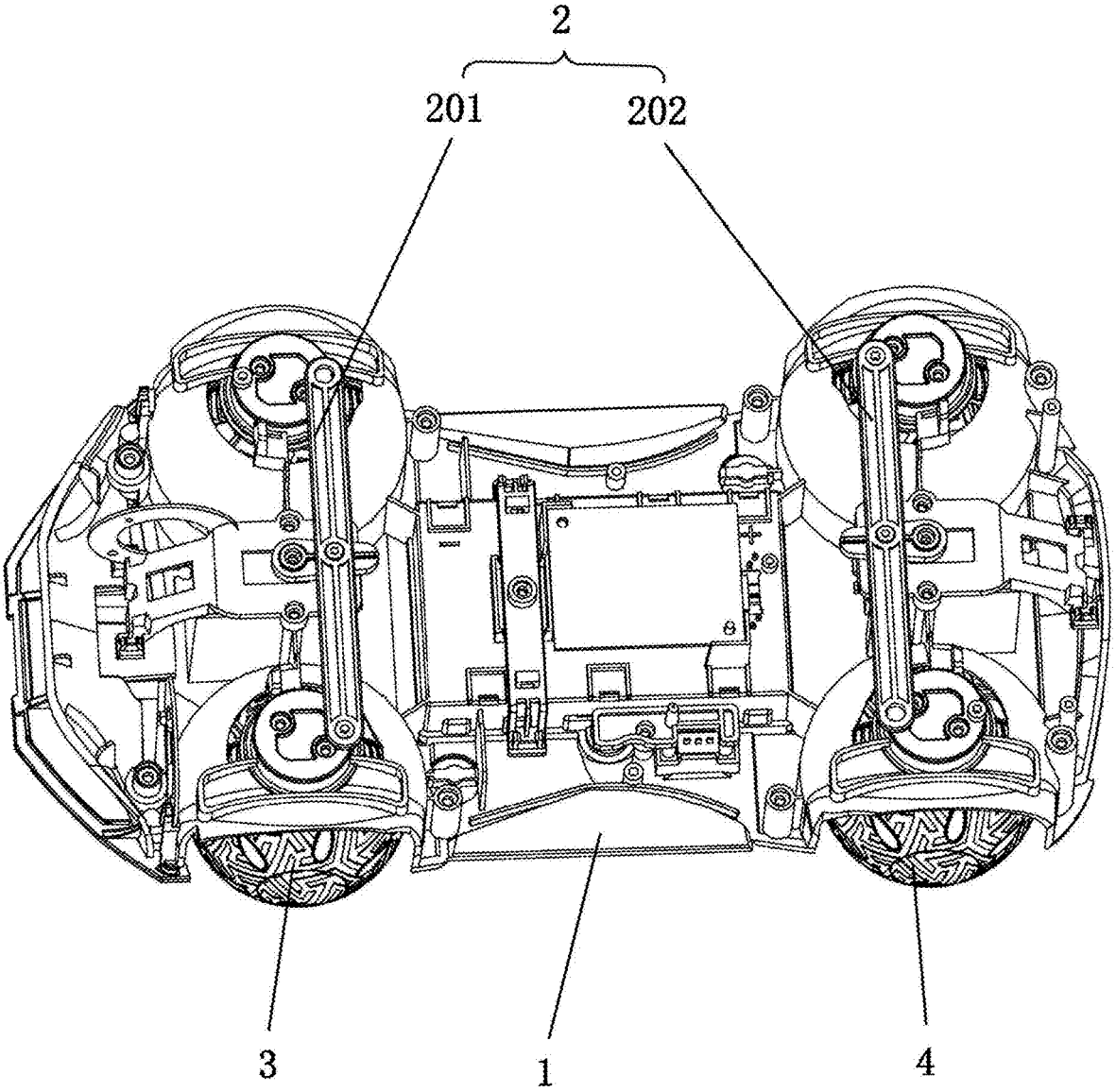
FIG. 2 is a perspective view of the inside of the remote-controlled toy vehicle with omnidirectional adjustable steering in Embodiment I of the present invention.
Figure 3:
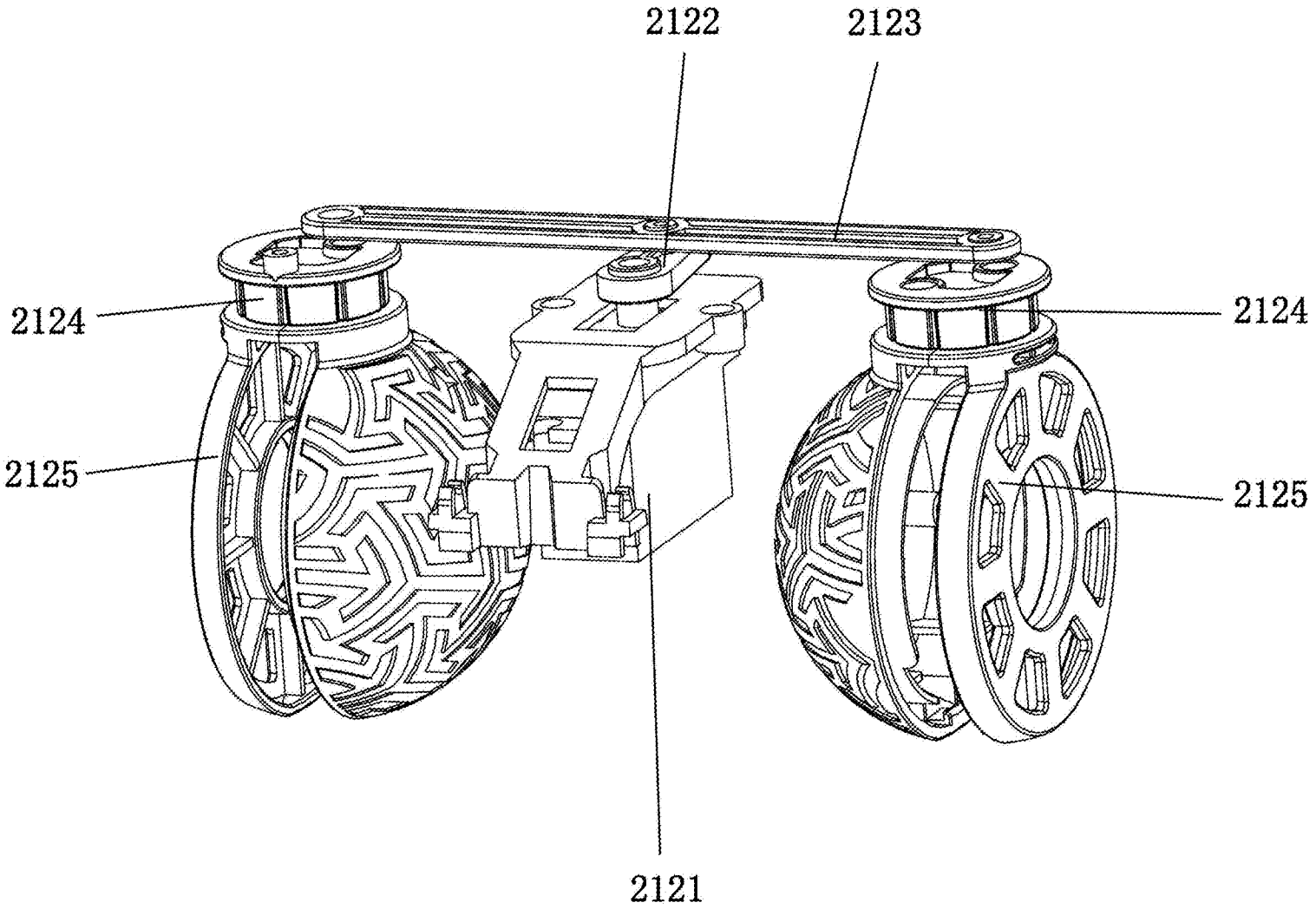
FIG. 3 is a perspective view of a front steering means or rear steering means in Embodiment I of the present invention.
Figure 4:
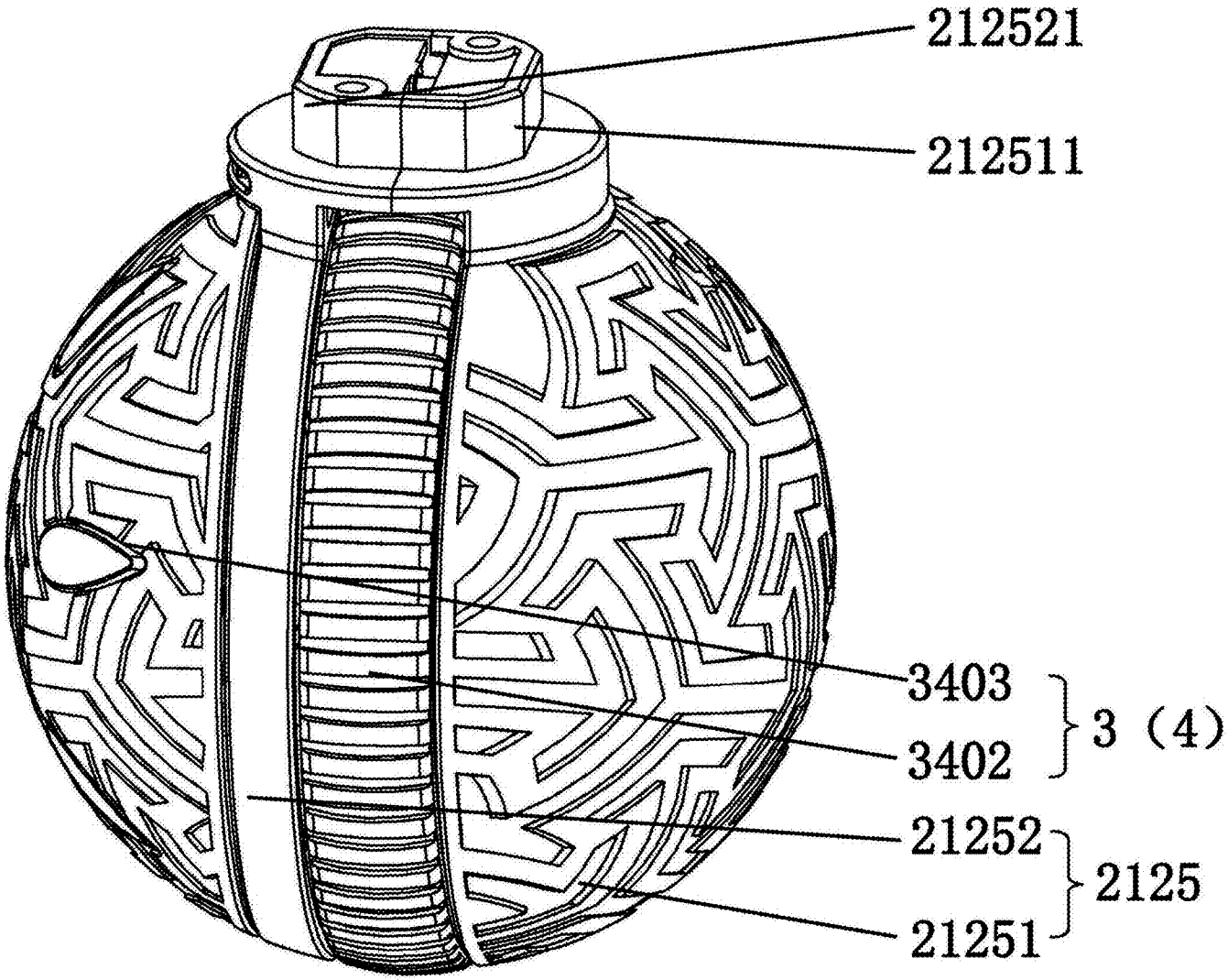
FIG. 4 is a perspective view of a front wheel or rear wheel, as well as a wheel bracket, in Embodiment I of the present invention.
Figure 5:
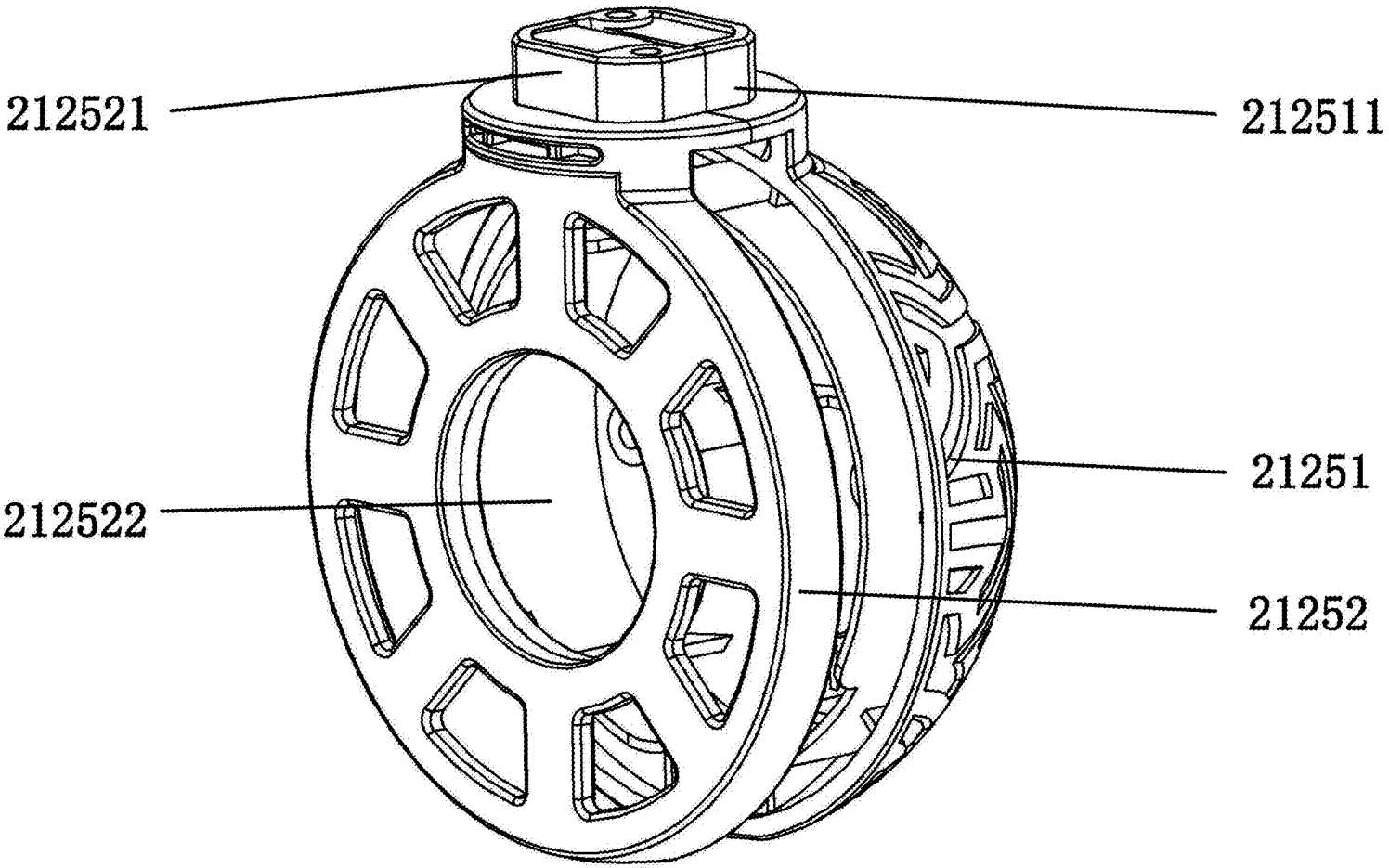
FIG. 5 is a perspective view of the wheel bracket in Embodiment I of the present invention.
Figure 6:
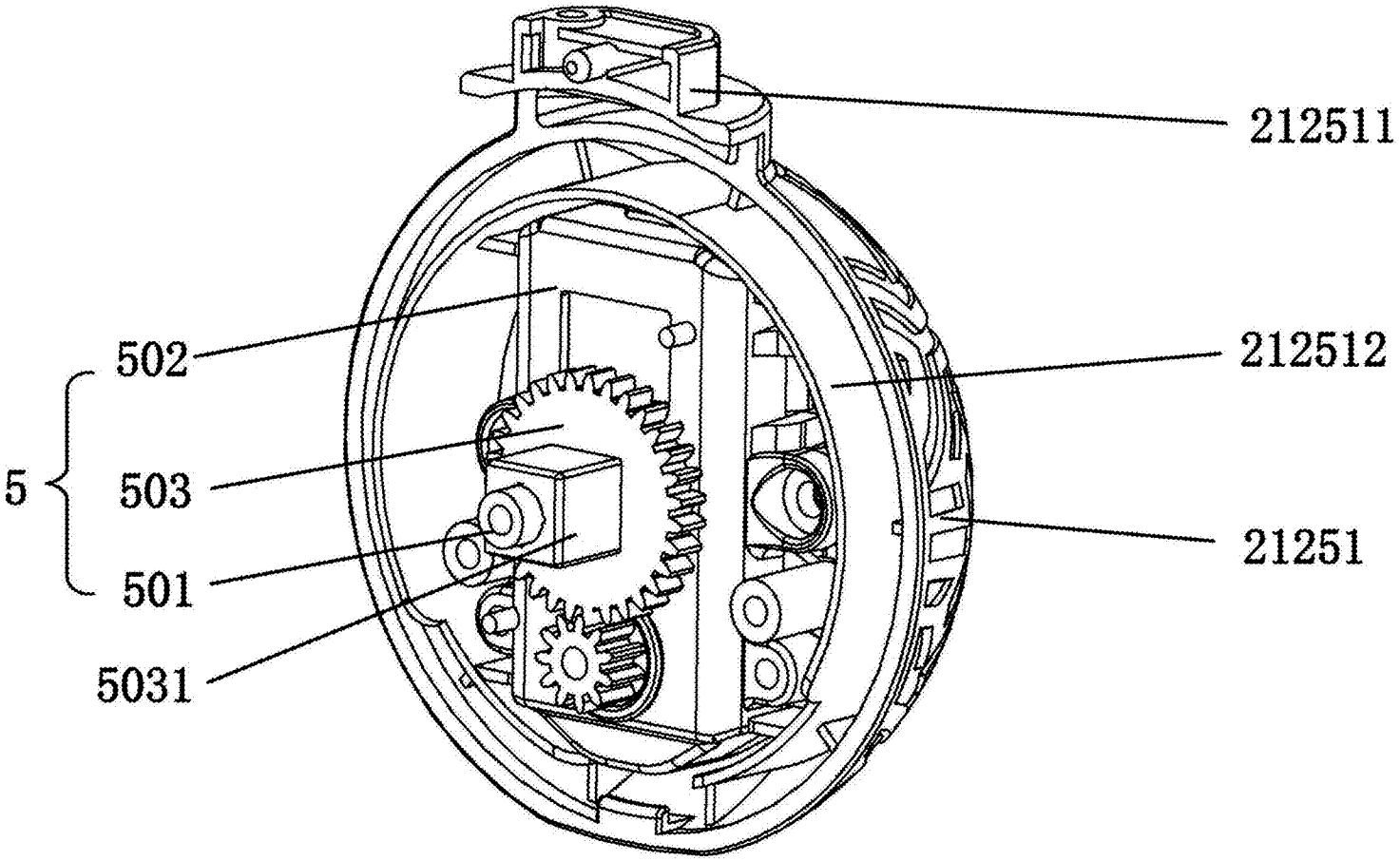
FIG. 6 is a perspective view of a wheel drive means, when installed in a first fixing member, in Embodiment I of the present invention.
Figure 7:
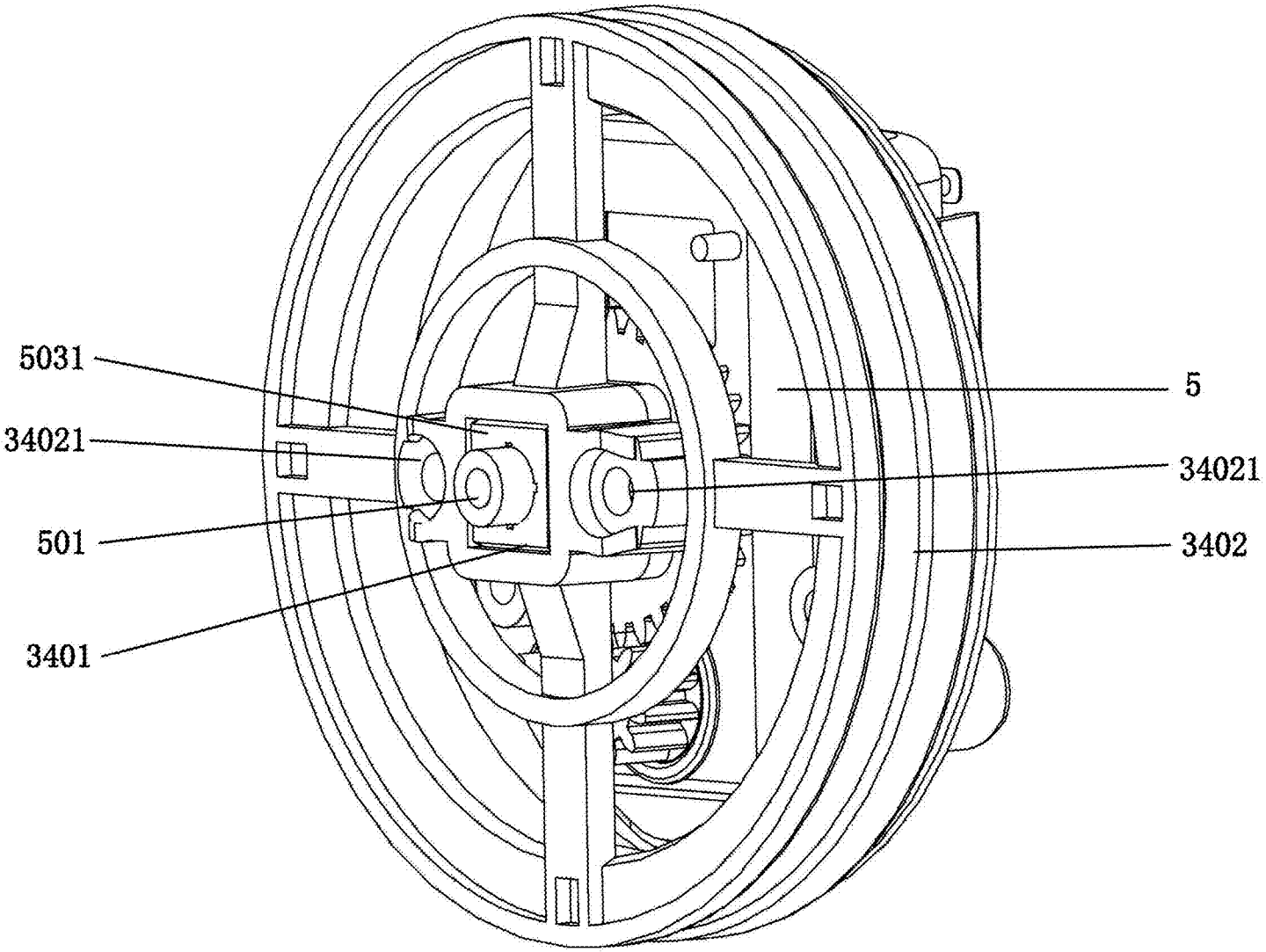
FIG. 7 is a perspective view of the wheel drive means, when engaged with the first rolling member, in Embodiment I of the present invention.
Figure 8:
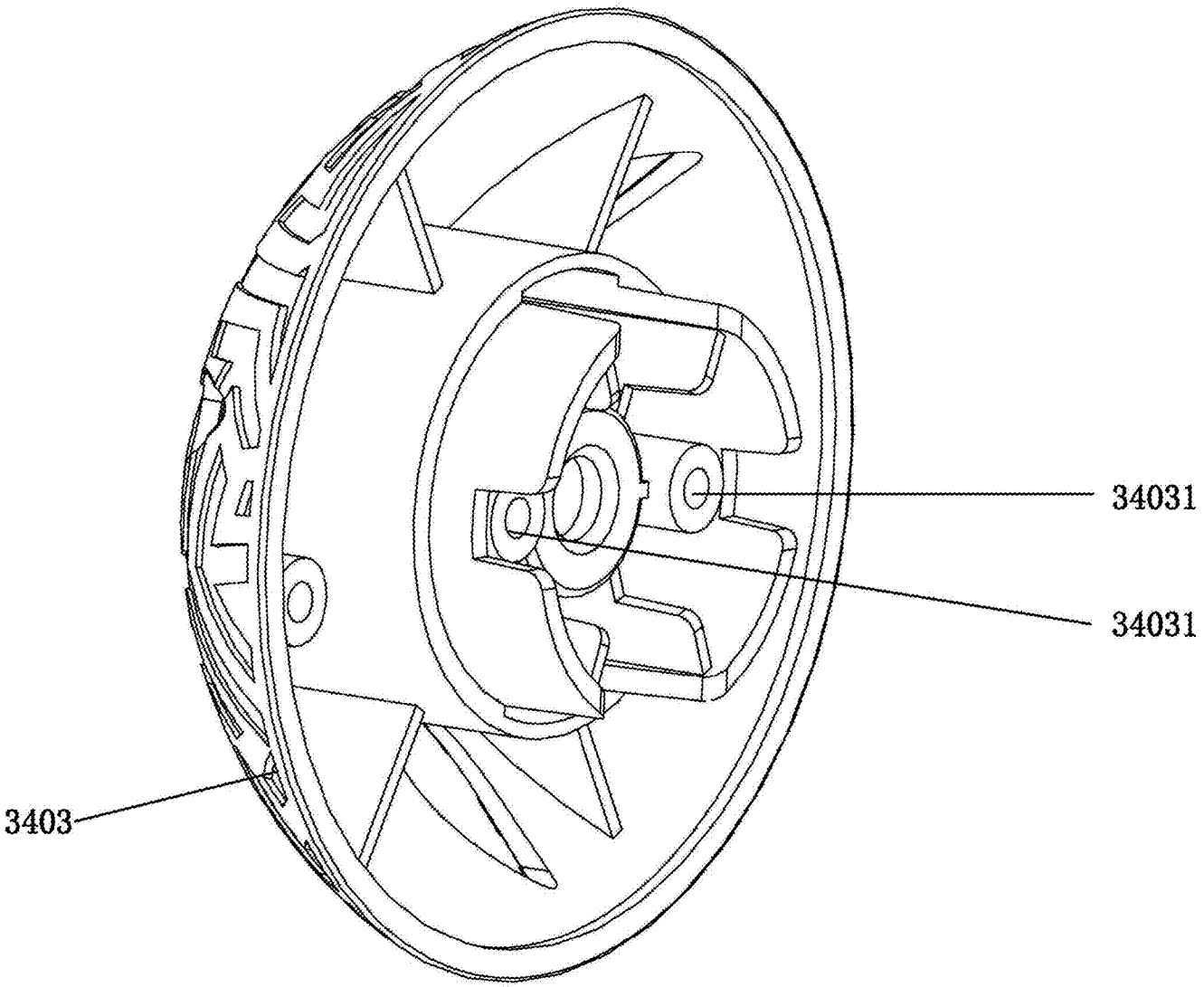
FIG. 8 is a perspective view of a second rolling member in Embodiment I of the present invention.

Set forth below are specific embodiments of the present invention and a further description of the technical solutions of the present invention in conjunction with the accompanying drawings, but the present invention is not limited to these embodiments.

Embodiment I

As shown in FIGS. 1-8, one embodiment of the a remote-controlled toy vehicle with omnidirectional adjustable steering comprises:

- a vehicle body 1 having a remote control receiving circuit;
- a remote control device (not shown) capable of communicating with the remote control receiving circuit;
- at least one steering means 201, 202 mounted on the vehicle body 1; and
- a plurality of wheels 3, 4;
- wherein each steering means 201, 202 comprises a steering drive means 2121, a pivot rod 2122, a connecting rod 2123, at least one swivelable member 2124, and at least one wheel bracket 2125, with the number of swivelable members 2124 and the number of wheel brackets 2125 in the steering means 201, 202 being the same as the number of the wheels 3, 4 connected to the steering means 201, 202;
- wherein in each steering means 201, 202, the pivot rod 2122 is connected at a first end to a power output end of the steering drive means 2121 and hinged at a second end to a middle of the connecting rod 2123;
- wherein each swivelable member 2124 is swivelably mounted on the vehicle body 1 and hinged to the connecting rod 2123 at a hinge position offset from a swivel center of the swivelable member 2124;
- wherein each wheel bracket 2125 is fixedly connected at an upper end to the swivelable member 2124 and hinged at a lower end to a corresponding wheel 3, 4; and
- wherein at least one wheel 3 at a front of the vehicle is independently driven from at least one wheel 4 at a rear of the vehicle.

In one embodiment of the above remote-controlled toy vehicle with omnidirectional adjustable steering, a front steering means 201 and a rear steering means 202 control steering of a front wheel 3 and a rear wheel 4, respectively, while the swivelable member 2124 positions its swivel center at a connection point with the wheel bracket 2125.

During a steering control, the steering drive means 2121 maneuver the connecting rod 2123 laterally. This lateral movement of the connecting rod 2123 also causes the connecting rod 2123 to move forward and backward, thereby changing an angular position of the hinge between the swivelable member 2124 and the connecting rod 2123, with respect to the swivel center of the swivelable member 2124. As a result, the movement of the connecting rod 2123 induces the swivelable member 2124 to swivel, leading to the swivel of the corresponding wheel brackets 2125, thereby enabling simultaneous swivel of the direction of all corresponding wheels 3, 4.

With such a steering mechanism 2 in the above remote-controlled toy vehicle with omnidirectional adjustable steering, a front steering means 201 and a rear steering means 202 can be implemented to independently drive front wheels and rear wheels respectively, or to independently drive left wheels and right wheels respectively.

Moreover, since the swivelable member 2124 is linked to a wheel via the wheel bracket 2125 rather than directly, the swivelable member 2124 and connecting rod 2123 can be positioned above or below a wheel, as well as offset from the wheel, thereby effectively circumvents constraints imposed by the wheel's position on the movement of the connecting rod 2123 and swivelable member 2124, theoretically enabling the swivelable member 2124 to swivel 360° (It should be noted that, in practical application, swiveling the swivelable member 2124 to 180° is sufficient, resulting in a wheel turning angle of 90° to both the left and right).

Under the combined steering of the front steering means 201 and rear steering means 202, the remote-controlled vehicle can achieve steering at various angles, and the steering angle can be finely adjusted as needed, making adjustment convenient.

Therefore, when using the front steering means 201 and rear steering means 202 to independently control steering of the front wheels and rear wheels 4 respectively, seamless omnidirectional steering of the remote-controlled vehicle can be achieved.

In the swivelable member 2124, a distance from the swivel center of the swivelable member 2124 to the hinge position of the swivelable member 2124, where the swivelable member 2124 is hinged to the connecting rod 2123, equals a length of the pivot rod 2122.

In each steering means, each swivelable member 2124 is provided with an eccentric hole, and the connecting rod 2123 is provided with a pin shaft capable of being inserted into the eccentric hole to hinge the swivelable member 2124 and the connecting rod 2123 together.

In each steering means, each swivelable member 2124 is a swivelable cylinder swivelably mounted on the vehicle body 1, and the eccentric hole is provided at a position offset from the swivel center of the swivelable cylinder.

In each steering means, the steering drive means 2121 is a servo drive, and the pivot rod 2122 is connected to an output shaft of the servo drive.

The steering drive means 2121 adopts a commonly seen servo drive, and during steering control, it operates similarly to typical remote-controlled vehicle steering mechanisms, enabling convenient adjustment of the steering angle as required.

One embodiment of the remote-controlled toy vehicle with omnidirectional adjustable steering further comprises a plurality of wheel drive means 5, with the number of the plurality of wheel drive means 5 being the same as the number of the plurality of wheels 3, 4; each of the plurality of wheels 3, 4, together with the corresponding wheel bracket 2125, form a first-type wheel-unit structure having a first inner cavity for accommodating a corresponding wheel drive means 5 and allowing a main body of the corresponding wheel drive means 5 to be mounted within the wheel bracket 2125; and each of the plurality of wheel drive means 5 is provided with a first mounting shaft 501, enabling each of the plurality of wheels 3, 4 to be rotatably sleeved onto the first mounting shaft 501 to establish a transmission connection with the power output end of the corresponding wheel drive means 5.

Each of the plurality of wheels 3, 4, together with the corresponding wheel bracket 2125, can combine to form a commonly seen wheel-unit structure; and each of the plurality of wheels 3, 4 can rotate relative to the corresponding wheel bracket 2125, and during rotation, can be driven by the corresponding wheel drive means 5 to rotate around the first mounting shaft 501.

This structure can increase the remote-controlled vehicle's horsepower, as each wheel is powered by an independent wheel drive means 5; furthermore, this structure enables the remote-controlled vehicle to seamlessly transition between various movement modes by providing individual control over the rotational speed of each wheel.

The wheel drive means 5 can be concealed in the hollow space within the first inner cavity, eliminating the need to occupy space within the vehicle body 1 of the remote-controlled vehicle, avoiding interference with an internal layout of the vehicle body 1 or the steering mechanism 2.

Each of the plurality of wheel drive means 5 comprises:

a first housing 502 fixedly mounted on the corresponding wheel bracket;

a first electric motor (not shown) mounted on the first housing; and a first gear set;

wherein the first mounting shaft 501 is mounted on the first housing 502;

wherein both the first electric motor and the first gear set are disposed within the first housing 502; and wherein an initial gear of the first gear set is mounted on an output shaft of the first electric motor, and a final gear 503 of the first gear set is rotatably sleeved onto the first mounting shaft 501 and connected to one of the plurality of wheels 3, 4.

The first electric motor, via the first gear set, drives each of the plurality of wheels 3, 4 to rotate around the first mounting shaft 501.

In each of the plurality of wheel drive means 5, a first shaft sleeve 5031 with a first external spline is positioned on a gear end face of the final gear 503 of the first gear set and rotatably sleeved onto the first mounting shaft 501; and each of the plurality of wheels 3, 4 is provided with a first internal splined hole 3401 for engaging with the first external spline on the corresponding first shaft sleeve 5031.

The final gear 503 of the first gear set, via the first shaft sleeve, can set each of the plurality of wheels 3, 4 into rotation.

In each steering means, each wheel bracket 2125 comprises a first fixing member 21251 and a second fixing member 21252; each of the plurality of wheels 3, 4 consists of a first rolling member 3402 and a second rolling member 3403; the first fixing member 21251, the first rolling member 3402, the second fixing member 21252, and the second rolling member 3403 are arranged in a right-to-left sequence to form the first-type wheel-unit structure; a first connecting member 212511 is provided on the first fixing member 21251, and a second connecting member 212521 matching the first connecting member 212511 is provided on the second fixing member 21252, so that the first fixing member 21251 is fixedly connected to the second connecting member 212521 on the second fixing member 21252 through the first connecting member 212511; each of the plurality of the wheel drive means 5 is fixedly mounted within a corresponding first fixing member 21251; a third connecting member 34021 is provided on the first rolling member 3402, and a fourth connecting member 34031 matching the third connecting member 34021 is provided on the second rolling member 3403, so that the first rolling member 3402 is fixedly connected to the fourth connecting member 34031 on the second rolling member 3403 through the third connecting member 34021; and the first internal splined hole 3401 is provided on the first rolling member 3402.

This structure enables the first fixing member 21251 and the second fixing member 21252 to restrict the lateral movement of the first rolling member 3402, thereby preventing lateral oscillation of the first rolling member 3402 during rotation.

One side edge of the first rolling member 3402 is provided with a first annular groove (not shown); and the first fixing member 21251 is provided with a second annular protruding ridge 212512 matching the first annular groove.

When the first rolling member 3402 comes into contact with the first fixing member 21251, the interaction between the annular protruding ridge and the annular groove can further restrain lateral oscillation of the first rolling member 3402 during rotation.

The first connecting member 212511 is disposed on an outer side of the first fixing member 21251; the second connecting member 212521 is disposed on an outer side of the second fixing member 21252; the first connecting member 212511 and the second connecting member 212521 are together connected to the swivelable member 2124; a first through hole 212522 is provided on the second fixing member 21252; the third connecting member 34021 is disposed on an inner side of the first rolling member 3402; the fourth connecting member 34031 is disposed on an inner side of the second rolling member 3403; the third connecting member 34021 passes through the first through hole 212522 to fixedly connected to the fourth connecting member 34031; the first internal splined hole 3401 is provided on the first rolling member 3402.

The third connecting member 34021 and the fourth connecting member 34031 are each configured with a different hole type: one with a through hole and the other with a threaded hole, facilitating their connection by inserting a screw through the through hole and securing the screw into the threaded hole.

The first fixing member 21251 and the second rolling member 3403 are respectively spherical-cap-shaped; the second fixing member 21252 and the first rolling member 3402 are respectively annular-ring-shaped; and the first fixing member 21251, the first rolling member 3402, the second fixing member 21252, and the second rolling member 3403 collectively form the first wheel-unit structure in a spherical shape. A first tire is provided on an outer surface of the first rolling member 3402, enhancing traction and preventing slippage.

Embodiment II

Figure 9:
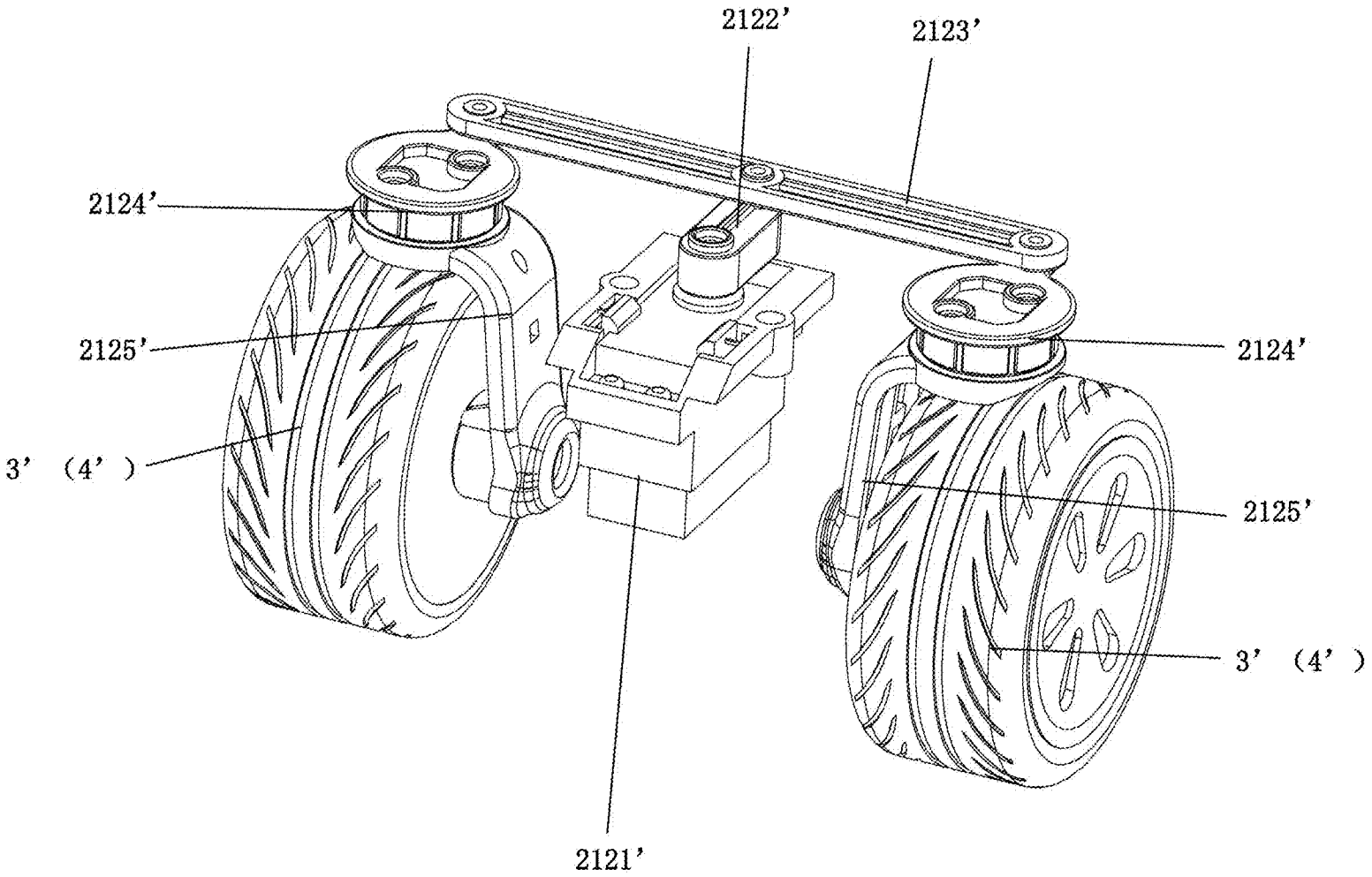
FIG. 9 is a perspective view of a front wheel installed on a front steering means, or a rear wheel installed on a rear steering means, in Embodiment II of the present invention.
Figure 10:
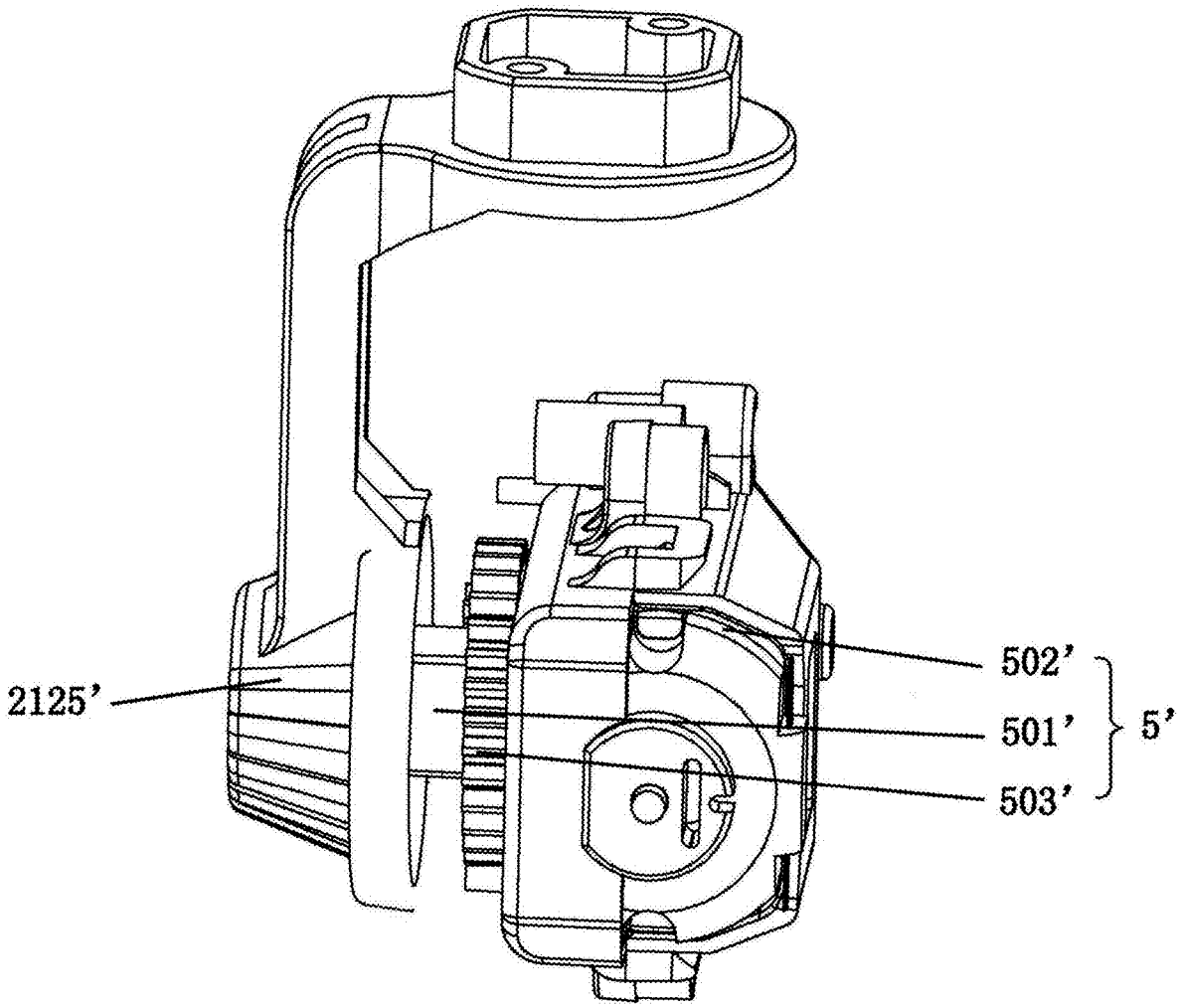
FIG. 10 is a perspective view of a wheel drive means, when installed on a wheel bracket, in Embodiment II of the present invention.
Figure 11:
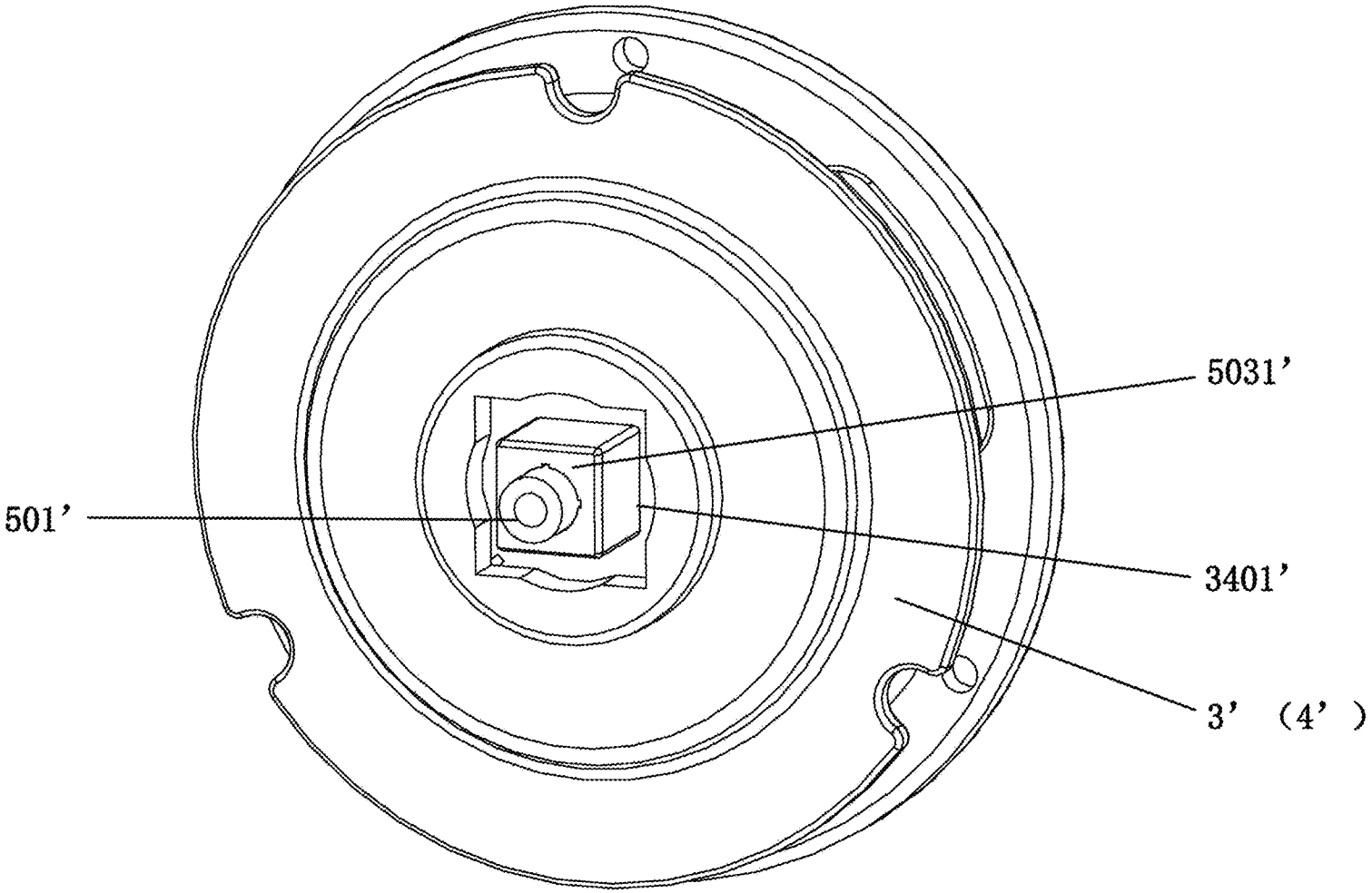
FIG. 11 is a perspective view of the wheel drive means, when engaged with a front wheel or real wheel, in Embodiment II of the present invention.

Differences between this embodiment and Embodiment I are as follows: as shown in FIGS. 9-11, each of the plurality of wheels 3', 4' forms a second-type wheel-unit structure having a second inner cavity and a second through hole 3401'; each of the plurality of wheel drive means 5' is disposed in a corresponding second inner cavity and is provided with a second mounting shaft 501'; in each of the plurality of wheel drive means 5', one end of the second mounting shaft 501' extends through the second through hole 3401' to the outside of a corresponding wheel 3', 4' and is fixedly connected to the corresponding wheel bracket 2125'; and each of the plurality of wheels 3', 4' is rotatably sleeved onto the second mounting shaft 501' to connect with a power output end of the corresponding wheel drive means 5'.

With this structure, the wheel drive means 5' can be concealed in the hollow space within the second inner cavity, eliminating the need to occupy space within the vehicle body of the remote-controlled vehicle, avoiding interference with an internal layout of the vehicle body or the steering mechanism, making it suitable for remote-controlled vehicles of various sizes;

each of the plurality of wheels 3', 4' can alone form a commonly seen wheel-unit structure; and each of the plurality of wheels 3', 4' can rotate relative to the corresponding wheel bracket 2125', and during rotation, can be driven by the corresponding wheel drive means 5' to rotate around the second mounting shaft 501'.

Each of the plurality of wheel drive means 5' comprises:

a second housing 502';

a second electric motor (not shown); and a second gear set; and wherein in each of the plurality of wheel drive means, the second mounting shaft 501' is positioned on the second housing 502', the second electric motor and the second gear set are respectively disposed in the second housing 502';

wherein an initial gear of the second gear set is in transmission connection with an output shaft of the second electric motor, a final gear 503' of the second gear set is rotatably sleeved onto the second mounting shaft 501' and connected to the corresponding wheel 3', 4'.

The second motor, via the second gear set, drives each of the plurality of wheels 3', 4' to rotate around the second mounting shaft 501'.

A second shaft sleeve 5031' with a second external spline is positioned on the final gear 503' of the second gear set and rotatably sleeved onto the second mounting shaft 501'; in each of the plurality of wheels 3', 4', the second through hole 3401' is a second internal splined hole matching the second external spline; and each of the plurality of wheels 3', 4' is engaged with the second external spline on a corresponding second shaft sleeve 5031' through the second internal splined hole.

A second tire is provided on and sleeved onto each of the plurality of wheels 3', 4'.

REFERENCED PARTS

1 Vehicle body
2 Steering mechanism
3, 3' Front wheel
4, 4' Rear wheel
201 Front steering means
202 Rear steering means
2121, 2121' Steering drive means
2122, 2122' Pivot rod
2123, 2123' Connecting rod
2124, 2124' Swivelable member
2125, 2125' Wheel bracket
5, 5' Wheel drive means
501 First mounting shaft
501' Second mounting shaft
502 First housing
502' Second housing
503 Final gear of the first gear set
503' Final gear of the second gear set
5031 First shaft sleeve
5031' Second shaft sleeve
3401 First internal splined hole
21251 First fixing member
21252 Second fixing member
3402 First rolling member
3403 Second rolling member
212511 First connecting member
212521 Second connecting member
34021 Third connecting member
34031 Fourth connecting member
212522 First through hole
3401' Second through hole

The invention claimed is:

1. A remote-controlled toy vehicle with omnidirectional adjustable steering, comprising:

a vehicle body having a remote control receiving circuit;

a remote control device capable of communicating with the remote control receiving circuit;

at least one steering means mounted on the vehicle body; and a plurality of wheels;

wherein each steering means comprises a steering drive means, a pivot rod, a connecting rod, at least one swivelable member, and at least one wheel bracket, with the number of swivelable members and the number of wheel brackets in the steering means being the same as the number of the wheels connected to the steering means;

wherein in each steering means, the pivot rod is connected at a first end to a power output end of the steering drive means and hinged at a second end to a middle of the connecting rod;

wherein each swivelable member is swivelably mounted on the vehicle body and hinged to the connecting rod at a hinge position offset from a swivel center of the swivelable member;

wherein each wheel bracket is fixedly connected at an upper end to the swivelable member and hinged at a lower end to a corresponding wheel; and wherein at least one wheel at a front of the vehicle is independently driven from at least one wheel at a rear of the vehicle.

2. The remote-controlled toy vehicle with omnidirectional adjustable steering as claimed in claim 1, wherein in each steering means, each swivelable member is provided with an eccentric hole, and the connecting rod is provided with a pin shaft capable of being inserted into the eccentric hole to hinge the swivelable member and the connecting rod together; and wherein in each steering means, each swivelable member is a swivelable cylinder swivelably mounted on the vehicle body, and the eccentric hole is provided at a position offset from the swivel center of the swivelable cylinder.

3. The remote-controlled toy vehicle with omnidirectional adjustable steering as claimed in claim 2, wherein there are two wheels, two swivelable members, and two wheel brackets at the front of the vehicle;

wherein there are two wheels, two swivelable members, and two wheel brackets at the rear of the vehicle; and wherein in each steering means, each of two ends of the connecting rod is hinged to the eccentric hole of a corresponding swivelable member.

4. The remote-controlled toy vehicle with omnidirectional adjustable steering as claimed in claim 1, wherein the remote-controlled toy vehicle with omnidirectional adjustable steering further comprises a plurality of wheel drive means, with the number of the plurality of wheel drive means being the same as the number of the plurality of wheels; and wherein each wheel drive means is mounted on a corresponding wheel bracket and has a power output end in transmission connection with one of the plurality of wheels.

5. The remote-controlled toy vehicle with omnidirectional adjustable steering as claimed in claim 4, wherein each of the plurality of wheels, together with the corresponding wheel bracket, form a first-type wheel-unit structure having a first inner cavity for accommodating a corresponding wheel drive means and allowing a main body of the corresponding wheel drive means to be mounted within the wheel bracket; and wherein each of the plurality of wheel drive means is provided with a first mounting shaft, enabling each of the plurality of wheels to be rotatably sleeved onto the first mounting shaft to establish a transmission connection with the power output end of the corresponding wheel drive means.

6. The remote-controlled toy vehicle with omnidirectional adjustable steering as claimed in claim 5, wherein each of the plurality of wheel drive means comprises:

a first housing fixedly mounted on the corresponding wheel bracket;

a first electric motor mounted on the first housing; and a first gear set disposed within the first housing;

wherein the first mounting shaft is mounted on the first housing; and wherein an initial gear of the first gear set is mounted on an output shaft of the first electric motor, and a final gear of the first gear set is rotatably sleeved onto the first mounting shaft and connected to one of the plurality of wheels.

7. The remote-controlled toy vehicle with omnidirectional adjustable steering as claimed in claim 6, wherein in each of the plurality of wheel drive means, a first shaft sleeve with a first external spline is positioned on a gear end face of the final gear of the first gear set and rotatably sleeved onto the first mounting shaft; and wherein each of the plurality of wheels is provided with a first internal splined hole for engaging with the first external spline on the corresponding first shaft sleeve.

8. The remote-controlled toy vehicle with omnidirectional adjustable steering as claimed in claim 7, wherein in each steering means, each wheel bracket comprises a first fixing member and a second fixing member;

wherein each of the plurality of wheels consists of a first rolling member and a second rolling member;

wherein the first fixing member, the first rolling member, the second fixing member, and the second rolling member are arranged in a right-to-left sequence to form the first-type wheel-unit structure;

wherein a first connecting member is provided on the first fixing member, and a second connecting member matching the first connecting member is provided on the second fixing member, so that the first fixing member is fixedly connected to the second connecting member on the second fixing member through the first connecting member;

wherein each of the plurality of the wheel drive means is fixedly mounted within a corresponding first fixing member;

wherein a third connecting member is provided on the first rolling member, and a fourth connecting member matching the third connecting member is provided on the second rolling member, so that the first rolling member is fixedly connected to the fourth connecting member on the second rolling member through the third connecting member; and wherein the first internal splined hole is provided on either the first rolling member or the second rolling member.

9. The remote-controlled toy vehicle with omnidirectional adjustable steering as claimed in claim 4, wherein each of the plurality of wheels forms a second-type wheel-unit structure having a second inner cavity and a second through hole;

wherein each of the plurality of wheel drive means is disposed in a corresponding second inner cavity and is provided with a second mounting shaft;

wherein in each of the plurality of wheel drive means, one end of the second mounting shaft extends through the second through hole to an outside of a corresponding wheel and is fixedly connected to the corresponding wheel bracket; and wherein each of the plurality of wheels is rotatably sleeved onto the second mounting shaft to connect with a power output end of the corresponding wheel drive means.

10. The remote-controlled toy vehicle with omnidirectional adjustable steering as claimed in claim 9, wherein each of the plurality of wheel drive means comprises:

a second housing;

a second electric motor; and a second gear set; and wherein in each of the plurality of wheel drive means, the second mounting shaft is positioned on the second housing, the second electric motor and the second gear set are respectively disposed in the second housing;

wherein an initial gear of the second gear set is in transmission connection with an output shaft of the second electric motor, a final gear of the second gear set is rotatably sleeved onto the second mounting shaft and connected to the corresponding wheel, a second shaft sleeve with a second external spline is positioned on the final gear of the second gear set and rotatably sleeved onto the second mounting shaft;

wherein in each of the plurality of wheels, the second through hole is a second internal splined hole matching the second external spline; and wherein each of the plurality of wheels is engaged with the second external spline on a corresponding second shaft sleeve through the second internal splined hole.

* * * * *